US011098906B2

(12) United States Patent
Heppi et al.

(10) Patent No.: US 11,098,906 B2
(45) Date of Patent: Aug. 24, 2021

(54) COMBINED APPLIANCE AND A KITCHEN DEVICE WITH THE COMBINED APPLIANCE

(71) Applicant: BSH Hausgeräte GmbH, Munich (DE)

(72) Inventors: Didier Heppi, Kertzfeld (FR); Aurélien Chartrel, Lingolsheim (FR); Robert Struppe, Landsberg (DE); Jean-Luc Lehn, Lingolsheim (FR)

(73) Assignee: BSH Hausgeräte GmbH, Munich (DE)

( * ) Notice: Subject to any disclaimer, the term of this patent is extended or adjusted under 35 U.S.C. 154(b) by 62 days.

(21) Appl. No.: 16/310,461

(22) PCT Filed: Aug. 7, 2017

(86) PCT No.: PCT/EP2017/069932
§ 371 (c)(1),
(2) Date: Dec. 17, 2018

(87) PCT Pub. No.: WO2018/036800
PCT Pub. Date: Mar. 1, 2018

(65) Prior Publication Data

US 2019/0186758 A1 Jun. 20, 2019

(30) Foreign Application Priority Data

Aug. 26, 2016 (EP) ..... 16290161

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2042; F24C 15/2085; F24C 15/2092; F24C 15/20; F24C 15/2028;
(Continued)

(56) References Cited

U.S. PATENT DOCUMENTS 4,411,254 A 10/1983 Field et al.
4,945,891 A * 8/1990 Cecil ..... F24C 15/2042 126/299 D (Continued)

FOREIGN PATENT DOCUMENTS

DE 102008050723 A1 4/2010
DE 202013005303 U1 6/2013

(Continued)

OTHER PUBLICATIONS

International Search Report PCT/EP2017/069932 dated Nov. 23, 2017.
Report of Examination EP 17 7 5 2 0 8 8. 9 dated Feb. 18, 2021.

*Primary Examiner* — Jason Lau
(74) *Attorney, Agent, or Firm* — Michael E. Tschupp; Andre Pallapies; Brandon G. Braun

(57) ABSTRACT

A combined appliance includes a hob and a fume extraction device which is integrated in the hob and includes a fume extraction housing and an air duct having an end which is connected to the fume extraction housing. The fume extraction housing has an accommodating space having at least one region adjacent to the hob for accommodating a fan. The air duct has a vertical region which runs downward. A circulating air filter is arranged in the air duct.

14 Claims, 5 Drawing Sheets

(58) Field of Classification Search
CPC ..... F24C 15/2064; F24C 15/2071; F24C 15/2078; B01D 46/10; B01D 2273/30; B01D 50/002; B01D 2257/91; B01D 2275/201; B01D 45/12; B01D 46/0002; B01D 46/0005; B01D 46/02; B01D 2258/0225; B01D 45/16; B01D 46/0065; B01D 46/0075; B01D 46/0091; B01D 46/24; B01D 46/446; B01D 46/521; B01D 2255/20707; B01D 2255/802; B01D 2257/106; B01D 2257/708; B01D 2258/06; B01D 2259/4508; B01D 2259/804; B01D 2265/02; B01D 2271/02; B01D 2273/28; B01D 2275/203; B01D 2275/206; B01D 2275/305; B01D 2277/20; B01D 2279/35; B01D 2279/50; B01D 2279/65; B01D 45/08; B01D 46/0023; B01D 46/0028; B01D 46/0032; B01D 46/0041; B01D 46/0068; B01D 46/12; B01D 46/2403; B01D 46/2411; B01D 46/4263; B01D 47/06; B01D 53/002; B01D 53/007; B01D 53/8668; B01D 53/885; B01D 5/009; A47L 5/32; A47L 5/34; A47L 5/30; A47L 9/1608; A47L 9/26; A47L 15/0092; A47L 5/225; A47L 5/28; A47L 9/0036; A47L 9/0072; A47L 9/02; A47L 9/0411; A47L 9/127; A47L 9/1427; A47L 9/1463; A47L 9/16; A47L 9/1666; A47L 9/1683; A47L 9/20; A47L 9/22; A47L 9/24; A47L 9/244; A47L 9/2842; A47L 9/2857; A47L 9/2878; A47L 9/325
See application file for complete search history.

(56) References Cited

U.S. PATENT DOCUMENTS

| | | | | |
|---|---|---|---|---|
| 5,231,972 | A | 8/1993 | Galassi | |
| 10,041,687 | B1 * | 8/2018 | Caneba | F24C 15/20 |
| 2003/0220070 | A1 * | 11/2003 | Orendorff | F24F 13/12 454/324 |
| 2003/0226444 | A1 * | 12/2003 | Khosropour | B01D 47/021 95/273 |
| 2010/0012110 | A1 | 1/2010 | Feisthammel et al. | |
| 2010/0163549 | A1 * | 7/2010 | Gagas | H05B 6/1209 219/622 |
| 2012/0204855 | A1 | 8/2012 | Huber | |
| 2013/0327315 | A1 * | 12/2013 | Sosso | F24C 15/20 126/39 E |
| 2014/0345461 | A1 * | 11/2014 | Sikkenga | B01D 45/16 95/272 |
| 2014/0352151 | A1 * | 12/2014 | Bruin-Slot | F24C 15/2071 29/897.3 |
| 2015/0083107 | A1 * | 3/2015 | Busch | A47J 36/38 126/25 R |
| 2016/0091211 | A1 * | 3/2016 | Min | F24C 15/2085 126/299 D |

FOREIGN PATENT DOCUMENTS

| | | | |
|---|---|---|---|
| EP | 3390918 | A1 | 10/2018 |
| JP | 2012007873 | A | 1/2012 |
| WO | 2017103708 | A1 | 6/2017 |

* cited by examiner

COMBINED APPLIANCE AND A KITCHEN DEVICE WITH THE COMBINED APPLIANCE

CROSS-REFERENCES TO RELATED APPLICATIONS

This application is the U.S. National Stage of International Application No. PCT/EP2017/069932, Aug. 7, 2017, which designated the United States and has been published as International Publication No. WO 2018/036800 A1 and which claims the priority of European Patent Application, Ser. No. 16290161.5, filed Aug. 26, 2016, pursuant to 35 U.S.C. 119(a)-(d).

BACKGROUND OF THE INVENTION

The invention relates to a combined appliance and a kitchen device with the combined appliance.

For cleaning air, in particular fumes and vapors which are produced during cooking, it is known to use fume extraction devices, air being suctioned thereby through a filter and cleaned on the filter. The fume extraction device may be a fume extractor hood which is arranged above a hob and which suctions air upwardly. Alternatively, however, fume extraction devices are also known in which air is suctioned downwardly from a hob. These fume extraction devices may also be denoted as hob extractor fans. The fume extraction device in this case is arranged adjacent to the hob. Alternatively, however, in the case of a hob extractor fan the blower may also be arranged below the hob and only one suction duct extends through the hob. Such a fume extraction device is disclosed, for example, in DE 92 12 278 U1. In this embodiment, the fan of the fume extraction device is arranged in a housing which is spaced apart from the hob and below the hob.

A drawback of this embodiment of the fume extraction device is that firstly the air is cleaned only via filter elements which are located in the suction pipe which is located above the hob. Secondly, due to the arrangement of the housing of the fan spaced apart from the hob, the suction performance of the fume extraction device is reduced.

BRIEF SUMMARY OF THE INVENTION

The object of the invention, therefore, is to provide a solution by means of which in a simple manner reliable cleaning of air which is suctioned from a hob may be ensured and yet an effective suction performance of the fume extraction device may be achieved. Additionally, the air is intended to be able to be discharged from the fume extraction device such that this air does not have a negative effect on the user of the combined appliance.

The invention is based on the recognition that this object may be achieved by the fan being arranged in the immediate vicinity of the hob or in the hob and an at least partially downwardly extending air duct being provided, said air duct being located in the direction of flow downstream of the fan and a circulating air filter being arranged in said air duct.

According to a first feature, the invention relates to a combined appliance comprising a hob with an integrated fume extraction device having a fume extraction housing and an air duct. The combined appliance is characterized in that an accommodating space in the fume extraction housing for a fan is provided in at least some regions adjacent to the hob, an end of the air duct is connected to the fume extraction housing, the air duct has a vertical region which runs downward and the air duct contains at least one circulating air filter.

According to the invention, an appliance which comprises a hob and a fume extraction device is denoted as a combined appliance. The fume extraction device in this case is integrated in the hob. A fume extraction device in which at least one part of the fume extraction housing is located in or on the hob or extends therethrough is denoted as being integrated in the hob. The fume extraction device is preferably arranged at least partially below the hob. The fume extraction housing according to the invention comprises an accommodating space for the fan of the fume extraction device. In this case, a region of the fume extraction housing in which the fan impeller of the fan may be moved by being driven by a motor is denoted as the accommodating space. The fan is preferably constituted by a radial fan. The axis of the fan is preferably located in the vertical direction.

The fume extraction device further comprises an air duct. A duct which is connected to the fume extraction housing and, in particular, the accommodating space and may be guided in the air from the fume extraction housing out of the fume extraction device and thus out of the combined appliance is denoted as the air duct. The air duct is arranged downstream of the fume extraction housing in the direction of flow of the air.

The accommodating space for the fan is provided at least in some regions adjacent to the hob. In particular, from below, the accommodating space is preferably adjacent to the lower face of the hob or is received at least in some regions in the lower face of the hob. An end of the air duct is connected to the fume extraction housing. As a result, air from the fume extraction housing and, in particular, the accommodating space may pass into the air duct. The air duct has a vertical region which runs downward.

Directional information such as vertical, horizontal, above and below refer to a combined appliance and the parts thereof in the assembled state, in particular in the state in which the combined appliance is installed in a kitchen unit, in particular a kitchen cabinet.

The air duct contains at least one circulating air filter. The circulating air filter is preferably arranged in the air duct such that all of the air flowing through the air duct is conducted through the circulating air filter. The circulating air filter may also be denoted as an odor filter and serves to filter out odors from the air which passes out of the fume extraction housing. The circulating air filter may be an active carbon filter, for example.

Since in the combined appliance the accommodating space is adjacent to the hob, the spacing between the fan, which is operated in the accommodating space, and an opening of the fume extraction device, via which air is suctioned from above the hob, is small. Thus reliable suctioning may be ensured. Since additionally an air duct is connected to the fume extraction housing and, in particular, the accommodating space which runs at least partially vertically downward, the air which passes out of the fume extraction housing may be moved downwardly to a location spaced apart from the hob and discharged there. A direct flow toward a user of the combined appliance, which could occur in the case of an air duct which only extended in the horizontal direction, may thus be avoided. Since finally the air duct contains a circulating air filter, odors can be removed from the air before the air is discharged from the combined appliance.

According to a preferred embodiment, the air duct consists of individual modules which are connected together. In this case, components which in each case form a longitudinal portion of the air duct are denoted as individual modules. The modules are preferably releasably connected together. The connection may be implemented, for example, by means of positive connecting elements. The connection may, for example, be a latching connection. The length of the air duct is formed by connecting the modules together. The number of modules and the longitudinal extent thereof in the direction of flow therefore define the length of the air duct.

Since the air duct is formed by individual modules connected together, the shape and length of the air duct may be adapted to the respective conditions in and around the combined appliance. As a result, the flexibility is increased and reliable suctioning and cleaning of the suctioned air is possible. In particular, by the use of individual modules the air outlet end of the air duct may be moved in a targeted manner to a point which is spaced apart from the fume extraction housing. In this case, different installation situations, for example different dimensions of the combined appliance and/or a kitchen cabinet in which the combined appliance is installed, may be taken into account.

According to a preferred embodiment, the circulating air filter is retained in a circulating air module which comprises a drawer for the circulating air filter and the circulating air module is arranged in the vertical region of the air duct. The circulating air module is constituted by a module of the air duct. Since the circulating air filter is accommodated in a circulating air module with a drawer, this circulating air filter may be removed in a simple manner by the user and replaced if required. In this case, a device which may be moved perpendicular to the longitudinal extent of the circulating air module and thus the longitudinal extent of the air duct in the region of the circulating air module is denoted as a drawer. The drawer may comprise a grid, which is also denoted as a retaining grid, and a plate, wherein in the inserted state the grid is located in the interior of the circulating air module and preferably covers the entire cross-section of the circulating air module perpendicular to the direction of flow. The circulating air filter may be positioned on this grid. The circulating air module is preferably arranged in the vertical region of the ventilation duct. By this arrangement the actuation of the drawer, in particular the insertion and/or extension thereof, is possible without having to act counter to the force of gravity. Additionally, in this arrangement the drawer may be reached more easily by the user than a drawer of a circulating air module which is located in a horizontal region of the air duct.

According to a preferred embodiment, the air duct at the end remote from the fume extraction housing comprises an air distribution device, air passing therethrough out of the air duct. Since an air distribution device is provided at the location at which air is discharged from the air duct and thus from the fume extraction device, a targeted outflow may be achieved. In particular, the air may be discharged in a direction which faces away from the user of the combined appliance. Preferably, one or more air guidance walls which in each case have a curvature are provided in the air distribution device. Particularly preferably, in one embodiment of the air distribution device at least two air guidance walls which are curved in opposing directions are provided. Thus the air flow which flows in the air duct may be separated into two partial flows flowing in opposing directions. Two air guidance walls with an opposing curvature may be located directly adjacent to one another at the apex so that air may be prevented from flowing out in the main direction of flow of the air duct.

According to one embodiment, the air duct comprises in each case a horizontal region above and below the vertical region. The upper horizontal region connects the fume extraction housing and, in particular, the accommodating space to the vertical region of the air duct. The lower horizontal region is located between the vertical region and the air outlet end of the air duct. Several advantages may be achieved by means of this embodiment. Firstly, the fume extraction housing and thus the fan may be provided at a position on the hob which is offset relative to the position of the vertical region. If the vertical region, for example, extends along the rear face of a kitchen cabinet in which the combined appliance is installed, the fume extraction housing and thus the fan may still be arranged in the central region of the hob. The lower horizontal region may be used to conduct the air flow to the air outlet end of the air duct which is spaced apart from the rear face of the kitchen cabinet. The air distribution device may in this case form the horizontal lower region of the air duct.

According to one embodiment, the air duct comprises at least one vertical compensation element and/or at least one horizontal extension element. A module which may be arranged between further modules of the air duct and which merely serves for the linear guidance of the air in the vertical direction between these further modules is denoted as the vertical compensation element. Thus the vertical compensation element, for example, may be a duct part which is open toward the top and bottom. Since the combined appliance according to the invention comprises at least one vertical compensation element, a vertical extent of the air duct which is required for the desired installation position may be adjusted. For example, when introducing the combined appliance into a countertop of a high kitchen cabinet, one or more vertical compensation elements may be used.

In the horizontal direction, the air duct may comprise at least one extension element. In this case, a module which may be arranged between further modules of the air duct and which merely serves for the linear guidance of the air in the horizontal direction between these further modules is denoted as the extension element. In a simple embodiment, therefore, the extension element is a duct part which is open to the front and to the rear.

The extension elements and the vertical compensation elements are optional modules of the air duct. The decision concerning the use of one of these modules may be taken when assembling the combined appliance.

According to one embodiment, at least one module of the air duct is a functional module. In this case, a module of the air duct in which the direction of the airflow in the air duct is altered or the airflow is filtered is denoted as the functional module. The functional module, therefore, may be an inlet arc, air being deflected thereby from the horizontal to the vertical. A further functional module may be an outlet arc, air being deflected therein from the vertical into the horizontal. Moreover, a functional module may be the circulating air module, the air being conducted therein through a circulating air filter.

Preferably, the at least one functional module may be installed in at least two orientations in the air duct. In particular, the functional modules may be rotated by an angle of 180° about the longitudinal direction of extent of the air duct in the region of the functional module and used in the rotated position. To this end, the functional modules preferably comprise an interface which has the same shape in the two installed orientations of the functional module. For example, the interface may have a rectangular shape.

Preferably, in the outlet arc the inlet opening is located perpendicular to the outlet opening. Thus, by rotating the outlet arc about the axis of the longitudinal extent the outlet opening, for example, may be oriented to the front, to the rear or to one of the sides. As a result, the air may be optionally discharged in different directions. If the functional module is the circulating air module, for example with a rotation of 180°, optionally the drawer may be oriented to the front or to the rear.

According to a preferred embodiment, at least one module in the region of the air duct in the vertical part is a module which is flexible at least in the longitudinal direction. The flexible module may comprise, for example, corrugated or folded walls or consist of a flexible material. If a flexible material is used, it is possible to compensate for slight height differences or a slight horizontal offset of modules to one another. Additionally, it is possible to compensate for an expansion or contraction of one or more modules due to temperature fluctuations. Thus damage to the air duct may be prevented.

In one embodiment, the guide duct may comprise an inlet arc, at least one vertically extending module, a circulating air module, an outlet arc and an air distribution device. In this embodiment, the inlet arc is connected to the fume extraction housing. The inlet arc comprises a vertically positioned inlet opening and a horizontal outlet opening. A vertically extending module is attached to the outlet opening, said vertically extending module connecting the inlet arc to the circulating air module. Thus the outlet arc is connected to the circulating air module. In this embodiment, for example, the vertically extending module may be a flexible module.

In a further embodiment, at least one horizontal extension element is provided between the fume extraction housing and the inlet arc.

Additionally or alternatively, at least one vertical compensation element may be accommodated in the air duct between the inlet arc and the outlet arc. This vertical compensation element may be located between the inlet arc and a flexible module, between the inlet arc and the circulating air module, between a flexible module and the circulating air module and/or between the circulating air module and the outlet arc or between a flexible module and the outlet arc.

According to a further feature, the invention relates to a kitchen device having a kitchen cabinet with a countertop and a combined appliance at least partially arranged in the kitchen cabinet. The kitchen device is characterized in that the combined appliance is a combined appliance according to the invention.

Advantages and features which have been described with reference to the combined appliance according to the invention—if applicable—correspondingly apply to the kitchen device according to the invention and vice versa.

Preferably a base cabinet is denoted as the kitchen cabinet. The kitchen cabinet may be part of a row of kitchen units or a separate piece of furniture. The kitchen cabinet is arranged in the vicinity of or on the floor of the room, i.e. the kitchen floor. The upper face of the kitchen cabinet is denoted as the countertop. Preferably, a cutout is introduced into this countertop, the combined appliance being at least partially accessible from above through said cutout. At least the fume extraction device is preferably arranged in the kitchen cabinet. The hob of the combined appliance is incorporated in the cutout. The hob may comprise a hob housing and a cover plate. The hob housing extends downwardly from the lower face of the cover plate. If the cover plate is located in the cutout, the hob housing is entirely accommodated in the kitchen cabinet. The fume extraction device preferably extends at least partially through the hob. According to one embodiment, the cover plate of the hob is positioned on supporting walls on the upper face of the fume extraction housing and a cutout of the hob is located in this region. Preferably, a filter unit of the fume extraction device is introduced into the cutout. The region of the fume extraction housing which forms the accommodating space for the fan is in at least some regions adjacent to the lower face of the hob. In particular, the upper face of the accommodating space may be adjacent to the lower face of a hob housing and may be fastened thereto.

According to one embodiment, the kitchen cabinet comprises a base, the hob of the combined appliance is accommodated in the countertop, the fume extraction housing of the fume extraction device is fastened to the lower face of the hob and the end of the air duct remote from the fume extraction housing is located below the base of the kitchen cabinet.

In this embodiment, the fume extraction housing may be screwed, for example, to the lower face of the hob housing of the hob. Since the end remote from the fume extraction housing, i.e. the air outlet end of the air duct, is located below the base of the kitchen cabinet, the air passing out of this end may be discharged into the room, in particular into the kitchen. Since the air outlet end in this position does not directly face the body of the user, a draft which might be felt by the user may be prevented.

According to a preferred embodiment, the vertical region of the air duct is located in the rear region of the kitchen cabinet. This arrangement in the combined appliance according to the invention is also possible with an arrangement of the fume extraction housing in the central region of the hob, since the spacing from the rear region may be covered by the inlet arc or with a larger spacing by one or more horizontal extension elements. Since the path of the air duct is offset to the rear, the space in the kitchen cabinet may also be used for further functions, for example as storage space. Preferably, drawers which are able to be withdrawn to the front out of the kitchen cabinet may be arranged in this interior. As a result, after the drawers have been withdrawn, access may be permitted at least to the vertical region of the air duct and, for example, a circulating air filter arranged therein may be replaced.

According to one embodiment, the fume extraction device comprises a fastening device for fastening the air duct and the fastening device is positioned on a base of the kitchen cabinet. This embodiment is advantageous since the upper face of the base of the kitchen cabinet is more easily accessible than the lower face thereof. However, it is also possible to fasten the fastening device to the lower face of the base of the kitchen cabinet.

According to a preferred embodiment, the fastening device extends from the front face of the air duct to the front. By means of such a projection, the air duct, for example, may be fastened to the base of the kitchen cabinet, in particular screwed thereon. Additionally, the front face of the air duct is easily accessible to the user.

According to a preferred embodiment, the fastening device comprises at least one marking for aligning with a cutout in the countertop of the kitchen cabinet. The marking may be a mechanical marking or a printed marking. For example, a notch may be incorporated in a rail as a mechanical marking. The marking serves for aligning with a cutout in the countertop of the kitchen cabinet. In the state in which the combined appliance is not yet installed in the kitchen cabinet, it is possible to view the cutout from above on the base of the kitchen cabinet. In this view from above, the spacing between the cutout and the front face of the air duct in the vertical region thereof is indicated by the marking. This may, for example, be a numerical marking. Corresponding to the marking provided on the fastening device, one or more horizontal extension elements may be made available which have corresponding markings. By reading off the marking, therefore, when assembling the combined appliance into the kitchen cabinet, the appropriate extension element may be selected and inserted into the air duct.

BRIEF DESCRIPTION OF THE DRAWINGS

The present invention is described hereinafter once again with reference to the accompanying drawings, in which.

DETAILED DESCRIPTION OF EXEMPLARY EMBODIMENTS OF THE PRESENT INVENTION

Figure 1:
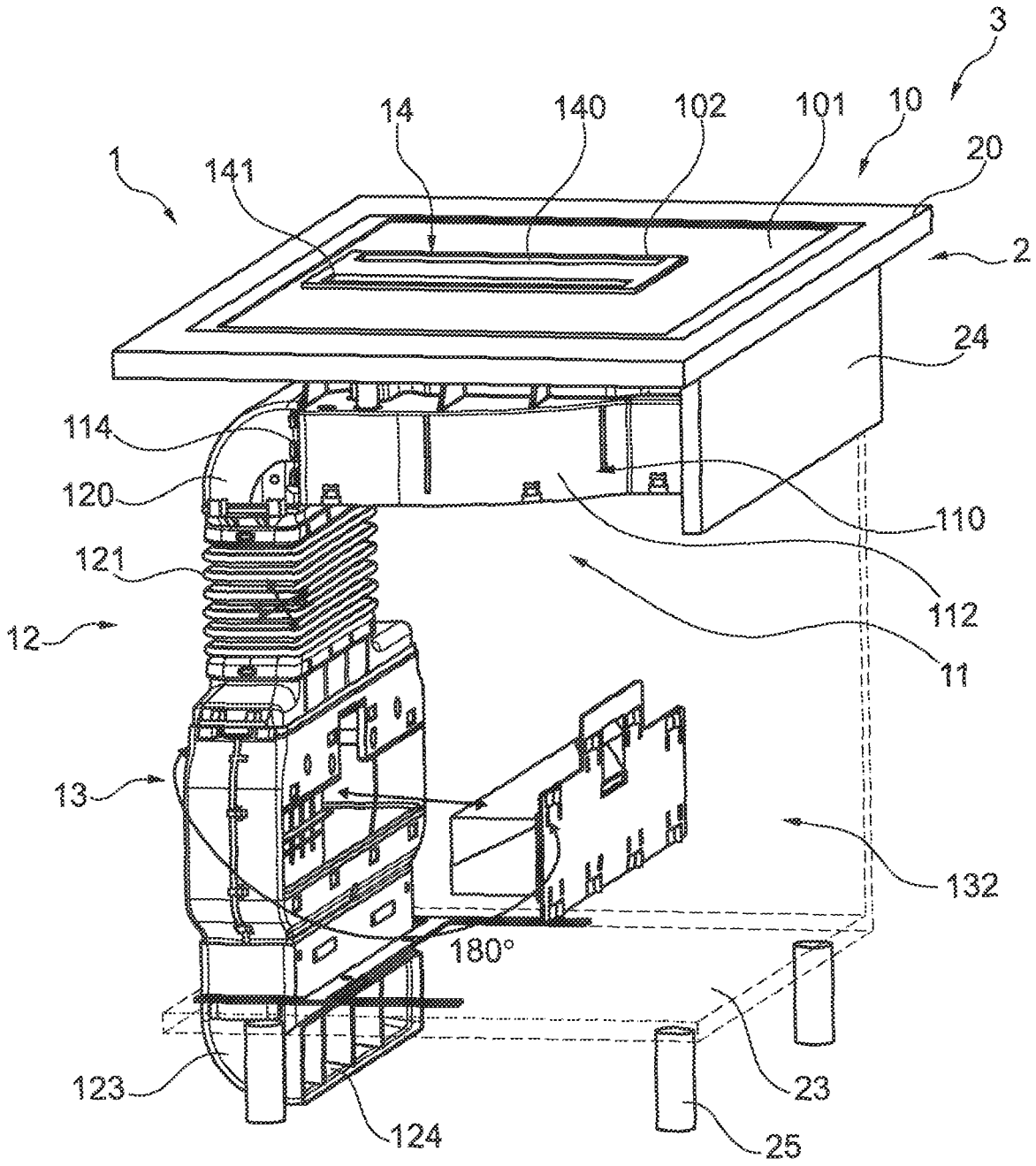
FIG. 1: shows a schematic perspective partial sectional view of a first embodiment of the kitchen device with an embodiment of the combined appliance.

In FIG. 1 a schematic perspective partial sectional view of a first embodiment of the kitchen device 3 is shown with an embodiment of the combined appliance 1. The kitchen device 3 consists of a kitchen cabinet 2 and a combined appliance 1 installed therein. The kitchen cabinet 2 has on the upper face a countertop 20 which upwardly defines the interior of the kitchen cabinet 2. The interior of the kitchen cabinet 2 is defined downwardly by a base 23, feet 25 being arranged on the lower face thereof, resulting in a spacing being created from the kitchen floor. At the sides the interior of the kitchen cabinet 2 is defined by side walls, only one thereof being visible in FIG. 1. The interior of the kitchen cabinet 2 is open to the rear in the embodiment shown. To the front, the interior is defined in the upper region by a panel 24.

A combined appliance 1 is installed in the kitchen cabinet 2. The combined appliance 1 consists of a hob 10 and a fume extraction device 11 integrated therein. The hob 10 comprises a cover plate 101. Preferably, a hob housing with heating modules (not shown) arranged therein is arranged below the cover plate 101. In the cover plate 101 a cutout 102 is provided in the central region of the cover plate 101 which in the embodiment shown extends in the depth direction of the hob 10.

The fume extraction device 11 comprises a fume extraction housing 110 and an air duct 12. In the embodiment shown, the fume extraction device 11 additionally comprises a filter unit 14, in FIG. 1 only the cover 140 thereof being visible with the inflow openings 141 provided therein. The filter unit 14 is incorporated in the cutout 102 of the cover plate 101 of the hob 10. The fume extraction housing 110 of the fume extraction device 11 is arranged below the filter unit 14. The fume extraction housing 110 is constituted by a spiral housing in which an accommodating space 112 for a fan (not shown) is formed. The fan is preferably a radial fan. The accommodating space 112 is designed such that the fan axis of the fan is located in the vertical direction. An air inlet opening 113 is incorporated in the upper face of the fume extraction housing 110 and, in particular, of the accommodating space 112, said air inlet opening facing the lower face of the hob 10 and in at least some regions being adjacent thereto. Via the air inlet opening 113 air may enter from above into the accommodating space. An air outlet opening 114 is incorporated in the side wall of the fume extraction housing 110 (see FIG. 2).

The air duct 12 is connected to the air outlet opening 114 of the fume extraction housing 110. In the embodiment shown in FIG. 1 in the direction of flow, the air duct 12 consists of an inlet arc 120, a flexible module which is denoted as a flexible duct part 121, a circulating air module 13, an outlet arc 123 and an air distribution device 124 at the air outlet end of the air duct 12. The air duct thus consists of individual modules 120, 121, 123, 124 which are connected together.

The vertical part of the air duct 12 is formed by the flexible duct part 121 and the circulating air module 13.

Figure 4:
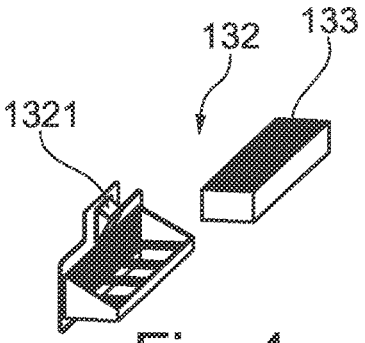
FIG. 4: shows a schematic perspective view of a drawer of the embodiment of the circulating air module according to FIG. 3.

The circulating air module 13 comprises a drawer 132 which may be inserted into an insertion opening 1310 on a housing 130 of the circulating air module 13. The drawer 132 consists of a panel 1321 and a retaining region for a circulating air filter attached to the panel 1321. The retaining region is, as shown in FIG. 4 for example, formed by a retaining grid 1320. The housing 130 of the circulating air module 13 in the embodiment shown is formed from two housing shells 131.

The air distribution device 124 is constituted by a component in which in the embodiment shown a plurality of air guidance walls 1240 are arranged, said air guidance walls being located in the direction of flow and in each case having a curvature.

Figure 2:
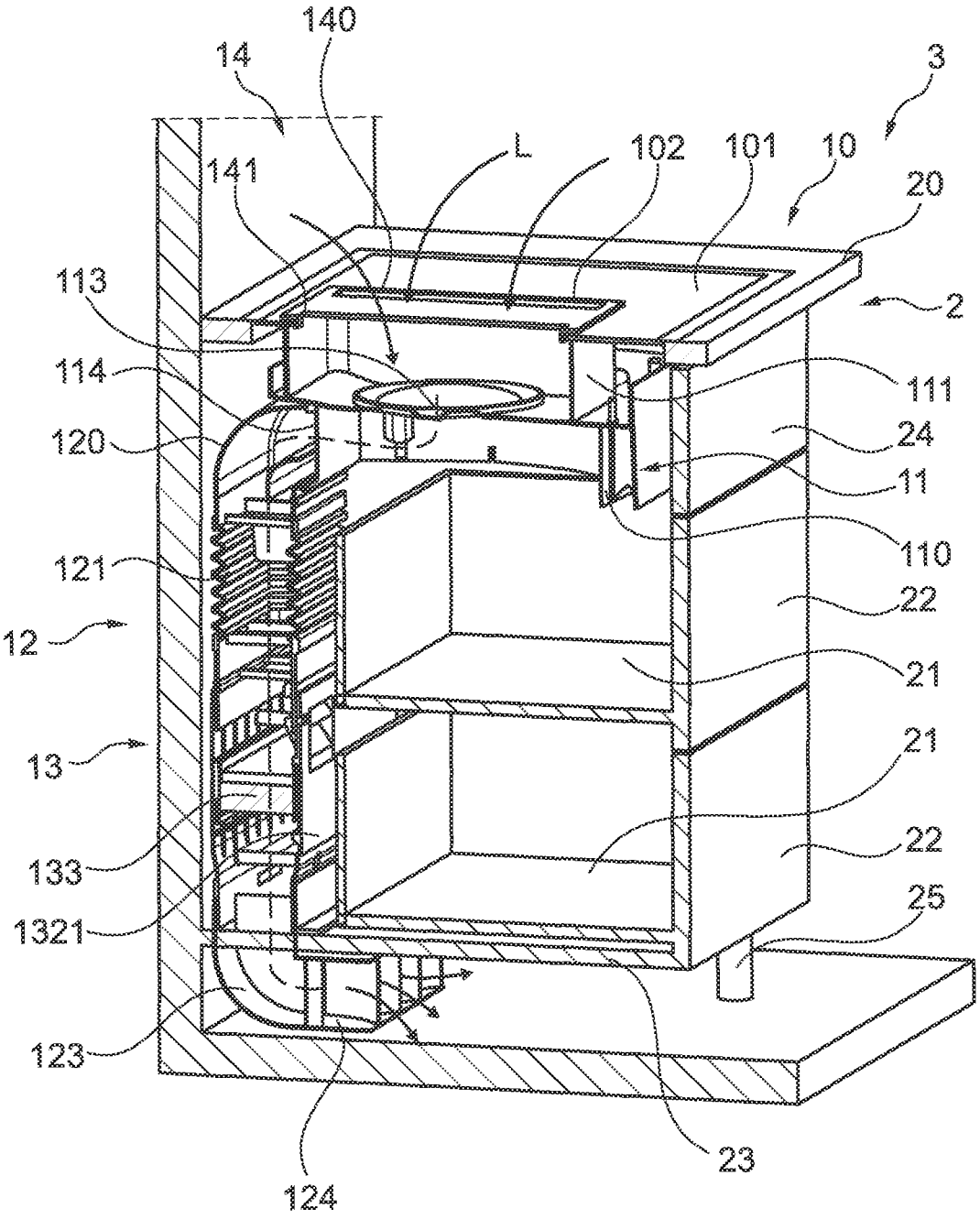
FIG. 2: shows a schematic perspective sectional view of the embodiment according to FIG. 1.

The air flow L through the combined appliance 1 in the kitchen cabinet 2 is indicated schematically in FIG. 2. In the view of FIG. 2, two drawers 22 are incorporated in the interior of the kitchen cabinet, in each case a storage space 21 being formed thereby.

Air enters the fume extraction device 11 via the inlet openings 141 of the filter unit 14. Upwardly protruding supporting walls 111 are provided on the upper face of the fume extraction housing 110, said supporting walls being supported from below against the cover plate 101 of the hob 10. The air inlet opening 113 of the fume extraction housing 110 is located below the cutout 102 in the cover panel 101. The air enters the fume extraction housing 110, in particular the accommodating space 112, via said air inlet opening. By means of the fan (not shown) arranged in the fume extraction housing 110, in particular in the accommodating space 112, the air is conveyed in the radial direction to the air outlet opening 114. From the air outlet opening 114, the air enters the inlet arc 120 in which the airflow is deflected from the horizontal to the vertical. From the inlet arc 120, the air enters the flexible duct part 121 and from there into the circulating air module 13 located thereunder in the air duct 12. In the air circulating module 13 the air flows through the circulating air filter 133. From the circulating air module 13 the air enters the outlet arc 123 in which the air flow is deflected from the vertical into the horizontal. From the outlet arc 123 the air enters the air distribution device 124. In this device, the airflow is divided into individual airflows in different directions. Additionally, a deceleration of the airflow may occur in the air distribution device 124 by the addition of the individual flow cross-sections, by means of the air guidance walls 1240. The air which has thus passed out of the air duct 12 is divided below the base 23 of the kitchen cabinet 2 and may pass out between the feet 25 of the kitchen cabinet 2 to the sides and optionally also partially to the front.

Figure 3:
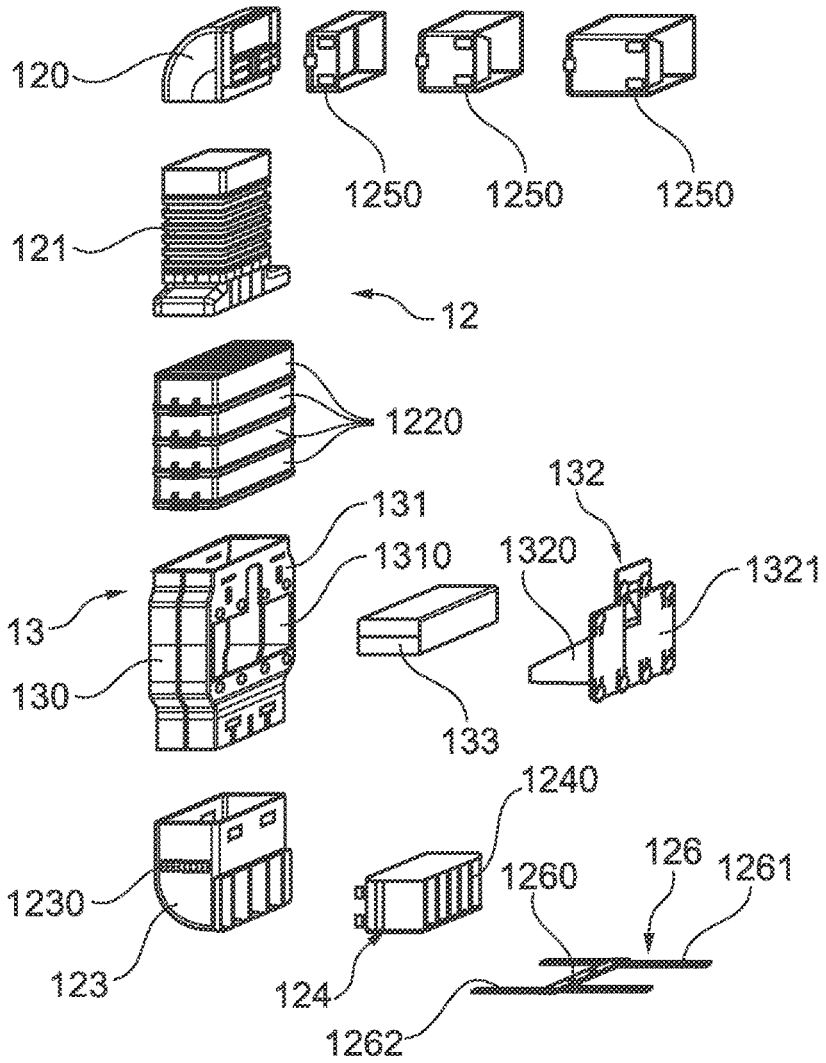
FIG. 3: shows a schematic perspective exploded view of a further embodiment of the air duct.

In FIG. 3 a further embodiment of the air duct 12 is shown in an exploded view. The embodiment according to FIG. 3 differs from the first embodiment of the air duct 12 of FIGS. 1 and 2 only in that additional components are contained therein. In particular, horizontal extension elements 1250 and vertical compensation elements 1220 are contained in the embodiment. Additionally, a fastening device 126 is shown, it being possible thereby to fasten the air duct 12 to the kitchen cabinet 2.

Three different horizontal extension elements 1250 which in each case differ by the length in the horizontal direction thereof are shown in FIG. 3. As is described below, however, only one horizontal extension element 1250 may be used.

Moreover, instead of the four vertical compensation elements 1220 shown in FIG. 3, in one embodiment of the air duct 12 only one, only two or only three vertical compensation elements 1220 may be used.

Figure 5:
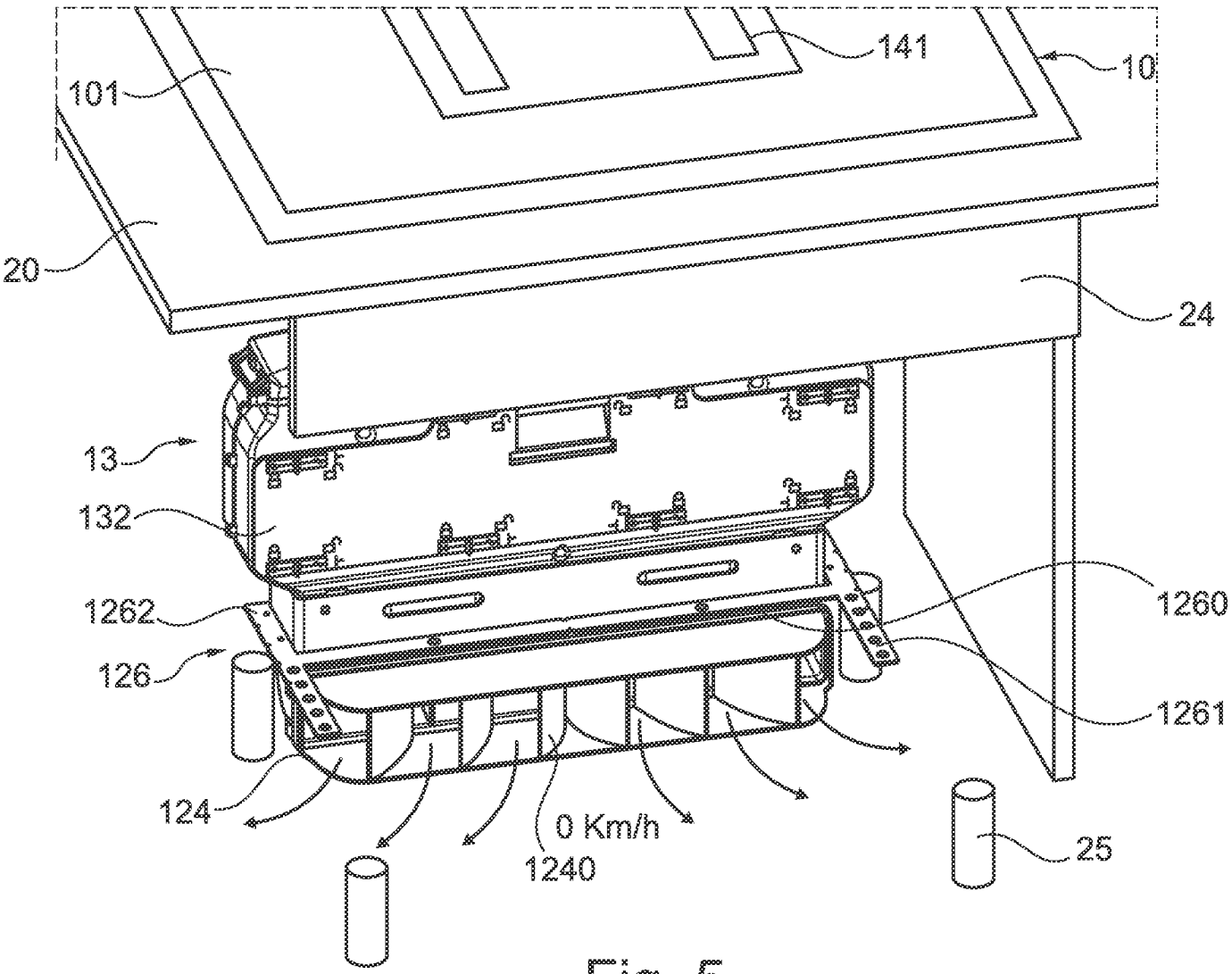
FIG. 5: shows a further schematic perspective front view from above of the embodiment according to FIG. 1.
Figure 6:
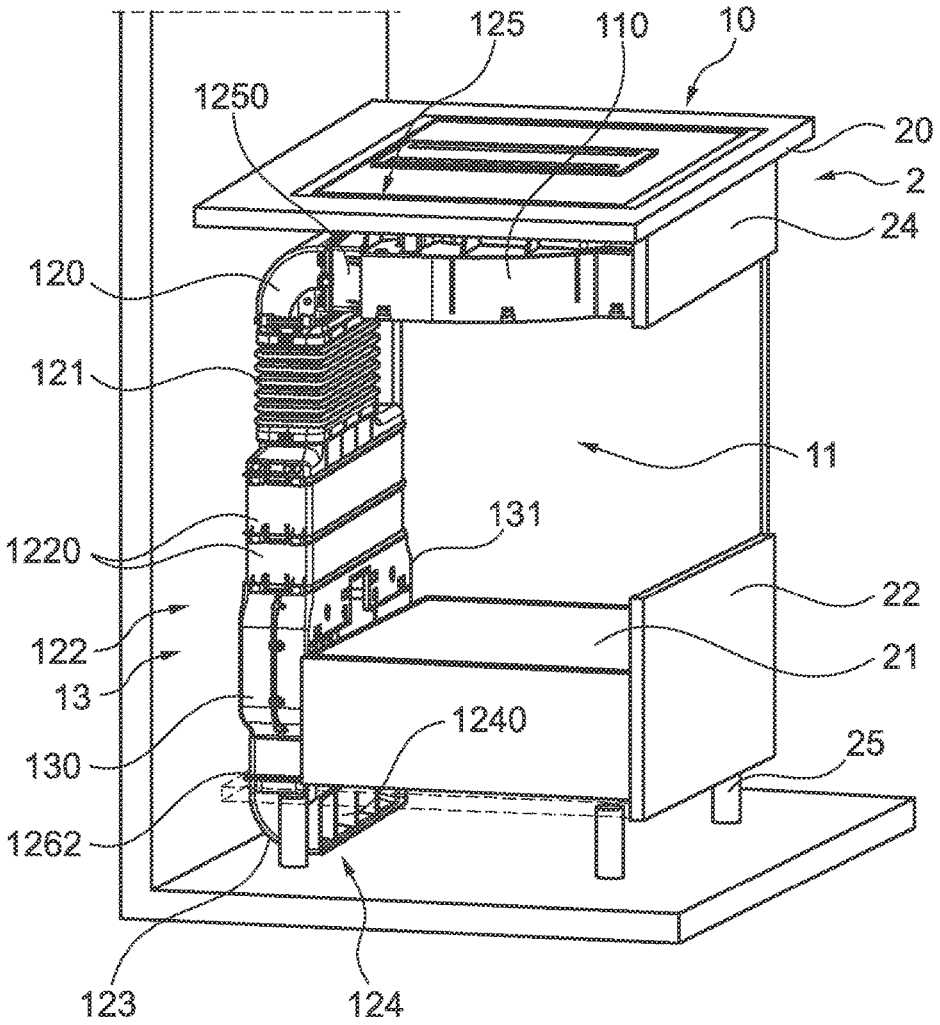
FIG. 6: shows a schematic perspective partial sectional view of a second embodiment of the kitchen device with a second embodiment of the combined appliance.

The air distribution device 124 according to one of the embodiments of the air duct 12 may be identified more clearly in FIG. 5. In particular, two types of air guidance walls 1240 are located in the air distribution device 124. The air guidance walls 1240 are located vertically and in each case have a curvature. In the left-hand region the air guidance walls 1240 are curved such that they conduct air to the left and in the right-hand region such that they conduct air to the right. In the middle, two air guidance walls 1240 are connected to one another and thus block a direct forward outflow of air from the air distribution device 124 to the front.

Moreover, an embodiment of the fastening device 126 in a state attached to the air duct 12 is shown in FIG. 5. The fastening device 126, which is also shown in FIG. 3, is a rail structure. The fastening device 126 consists of a bottom rail 1260 which is placed on the front face of the air duct 12, in particular on the front face of the upper region of the outlet arc 123. From the base rail 1260, two limbs 1261 extend to the front and two limbs 1262 extend to the rear. The rearwardly oriented limbs 1262 bear against the side walls of the air duct 12, in particular against the side walls of the outlet arc 123. To this end, a fastening projection 1230 on each of the side walls may be provided on the outlet arc 123. The limbs 1262 may be fastened to this fastening projection 1230, in particular screwed thereon. The limbs 1261, which are oriented to the front in the embodiment shown, are at a smaller spacing from one another than the rearwardly oriented limbs 1262. Screw holes 1264 are incorporated in the limbs 1261, 1262.

Figure 8:
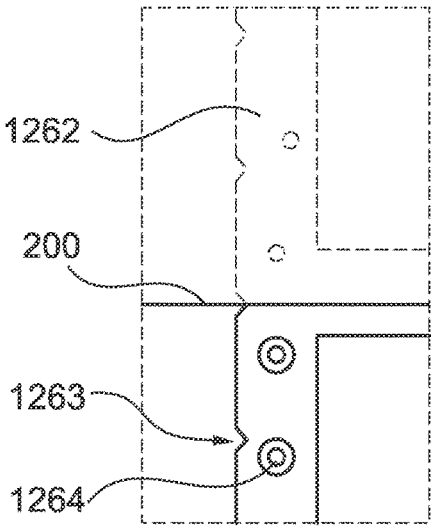
FIG. 8: shows a schematic detailed view of the detail of the kitchen cabinet according to FIG. 7.
Figure 7:
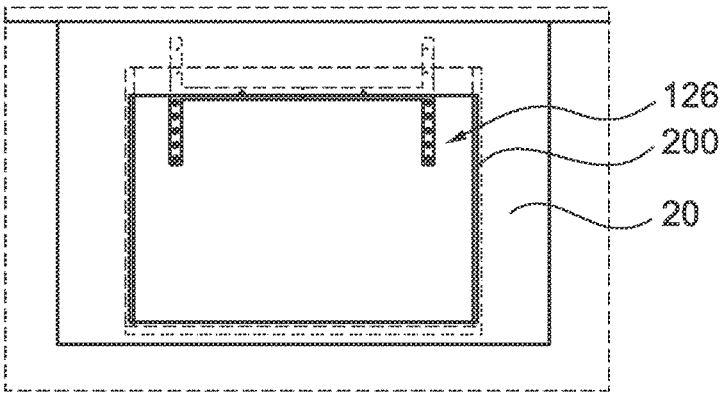
FIG. 7: shows a schematic view from above of an embodiment of a kitchen cabinet during the installation of a combined appliance.

The use of the fastening device 126 during assembly is described with reference to FIGS. 7 and 8.

After a cutout 200 has been incorporated in the kitchen cabinet 2, in particular in the countertop 20 thereof, the fastening device 126 is placed on the base 23 of the kitchen cabinet 2 and displaced sufficiently far to the rear until the rearwardly protruding limbs 1262 bear against a rear wall of the kitchen cabinet 2 or against a room wall to which the kitchen cabinet is fastened. In this application, the length of the rearwardly oriented limbs 1262 corresponds to the depth of the air duct 12. Markings 1263 are provided on the limbs 1261. By viewing the cutout 200 in the countertop 20 from above, the marking 1263 on which the edge of the cutout 200 is located is seen. The horizontal extension elements 1250 are provided with appropriate markings corresponding to their length. Thus the fitter is able to read off from the fastening device 126 which horizontal extension element 1250 has to be used in order to be able to ensure a reliable connection between the fume extraction housing 110 and the inlet arc 120.

An embodiment in which the corresponding horizontal extension element 1250 has been used is shown in FIG. 5.

The invention has a series of advantages. In particular, the circulating air filter is easily accessible for the user and may be replaced in a simple manner. The circulating air module may be rotated by 180° in the air duct, whereby it is possible to remove the circulating air filter from the front or from the rear. The air distribution device may also be attached to the air guidance duct, rotated by 180°. As a result, the blow-out direction may be oriented either to the front or to the rear. The entire construction of the kitchen device is simple, it permits a reliable suctioning of air from above the hob and additionally preferably provides the largest part of the interior for other purposes, such as for example storage space.

REFERENCE CHARACTERS

1 Combined appliance
10 Hob
101 Cover plate
102 Cutout
11 Fume extraction device
110 Fume extraction housing
111 Supporting wall
112 Accommodating space
113 Air inlet opening
114 Air outlet opening
12 Air duct
120 Inlet arc
121 Flexible duct part
1220 Vertical compensation element
123 Outlet arc
1230 Fastening projection
124 Air distribution device
1240 Air guidance wall
1250 Extension element
126 Fastening device
1260 Bottom rail
1261 Limb
1262 Limb
1263 Marking
1264 Screw hole
13 Circulating air module
130 Housing
131 Housing shell
1310 Insertion opening
132 Drawer
1320 Retaining grid
1321 Cover plate
133 Circulating air filter
14 Filter unit
140 Cover
141 Inflow opening
2 Kitchen unit

20 Countertop
200 Cutout
21 Storage space
22 Drawer
23 Base
24 Panel
25 Foot
3 Kitchen device
L Airflow

The invention claimed is:

1. A combined appliance, comprising:

a hob;

a fume extraction device integrated in the hob and including a fume extraction housing and an air duct having an end which is connected to the fume extraction housing, said fume extraction housing including an accommodating space having at least one region adjacent to the hob for accommodating a fan for directing air in a horizontal direction, said air duct having:

a first horizontal region in which air is deflected from the horizontal direction to a vertical direction, a vertical region which runs downward from the horizontal region, the vertical region having:

a telescoping region, and a circulating air filter disposed in the vertical region of the air duct; and a second horizontal region disposed below the vertical region in which air is deflected from the vertical direction to the horizontal direction, wherein the first horizontal region and the second horizontal region are arced.

2. The combined appliance of claim 1, wherein the air duct includes individual modules which are connected together.

3. The combined appliance of claim 1, wherein the air duct has an alternate end remote from the fume extraction housing, and further comprising an air distribution device which is arranged at the alternate end of the air duct and via which air is divided into individual airflows in different directions that exit the air duct.

4. The combined appliance of claim 1, further comprising at least one member selected from the group consisting of a vertical compensation element and a horizontal extension element, said member being arranged in the air duct.

5. The combined appliance of claim 2, wherein at least one module of the air duct is a functional module configured for installation in at least two orientations in the air duct.

6. The combined appliance of claim 5, wherein the functional module is an inlet arc, an outlet arc or a circulating air module.

7. The combined appliance of claim 2, wherein at least one module of the air duct is flexible at least in a longitudinal direction and forms a region in a vertical part of the air duct.

8. The combined appliance of claim 1, further comprising a horizontal extension element located between the fume extraction housing and the inlet arc, and/or a vertical compensation element accommodated between the inlet arc and the outlet arc.

9. A kitchen device, comprising:

a kitchen cabinet including a countertop; and a combined appliance at least partially arranged in the kitchen cabinet, said combined appliance comprising a hob, a fume extraction device integrated in the hob and including a fume extraction housing and an air duct having an end which is connected to the fume extraction housing, said fume extraction housing including an accommodating space having at least one region adjacent to the hob for accommodating a fan, said air duct having a vertical region which runs downward comprising: a telescoping region, a circulating air module arranged in the vertical region of the air duct below the telescoping region and having an insertion opening, a drawer arranged in the insertion opening and having a panel which closes the insertion opening, a retaining region arranged on the drawer, and a circulating air filter arranged in the retaining region, wherein the fume extraction device comprises a fastening device positioned on a base of the kitchen cabinet for fastening the air duct and extending from a front face of the air duct forwards, said fastening device comprising a marking for aligning with a cutout in the countertop of the kitchen cabinet.

10. The kitchen device of claim 9, wherein the hob of the combined appliance is arranged in the countertop and the fume extraction housing of the fume extraction device is fastened to a lower face of the hob, said air duct having an alternate end remote from the fume extraction housing, said kitchen cabinet comprising a base, with the alternate end of the air duct being located below the base of the kitchen cabinet.

11. The kitchen device of claim 9, wherein the vertical region of the air duct is located in a rear region of the kitchen cabinet.

12. The combined appliance of claim 1, further comprising:

a circulating air module arranged in the vertical region of the air duct, the circulating air module having an insertion opening; and a drawer arranged in the insertion opening, the drawer having a panel which closes the insertion opening and a retaining region, wherein the circulating air filter is arranged in the retaining region of the air duct.

13. The combined appliance of claim 12, wherein the circulating air module is disposed below the telescoping region of the air duct.

14. The combined appliance of claim 3, wherein the individual airflows are decelerated as they pass through the air distribution device.

* * * * *